US009459570B2

(12) United States Patent
Saiki et al.

(10) Patent No.: US 9,459,570 B2
(45) Date of Patent: Oct. 4, 2016

(54) FIXING DEVICE, HEATING DEVICE, IMAGE FORMING APPARATUS, AND METHOD OF MANUFACTURING HEATING DEVICE

(71) Applicant: FUJI XEROX CO., LTD., Tokyo (JP)

(72) Inventors: Mikio Saiki, Kanagawa (JP); Mitsuhiro Matsumoto, Kanagawa (JP); Kazuyoshi Ito, Kanagawa (JP); Yasuhiro Uehara, Kanagawa (JP); Atsumi Kurita, Kanagawa (JP); Hideaki Ohara, Kanagawa (JP); Hiromi Nagai, Kanagawa (JP); Nobuyoshi Komatsu, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/189,504

(22) Filed: Feb. 25, 2014

(65) Prior Publication Data

US 2015/0030360 A1 Jan. 29, 2015

(30) Foreign Application Priority Data

Jul. 29, 2013 (JP) ..... 2013-156670

(51) Int. Cl.
*G03G 15/20* (2006.01)

(52) U.S. Cl.
CPC ..... *G03G 15/2053* (2013.01); *G03G 15/2057* (2013.01); *G03G 15/2064* (2013.01); *G03G 2215/2029* (2013.01); *G03G 2215/2035* (2013.01); *Y10T 156/1048* (2015.01)

(58) Field of Classification Search
CPC ..... G03G 15/2017; G03G 15/2053; G03G 2215/2035
USPC ..... 399/329, 333
See application file for complete search history.

(56) References Cited

U.S. PATENT DOCUMENTS

| | | | | |
|---|---|---|---|---|
| 2002/0076243 | A1* | 6/2002 | Nakafuji et al. | 399/329 |
| 2003/0002895 | A1* | 1/2003 | Kato | G03G 15/2053 399/333 |
| 2003/0063931 | A1* | 4/2003 | Sanpei et al. | 399/328 |
| 2003/0183610 | A1* | 10/2003 | Okabayashi | G03G 15/2064 219/216 |
| 2009/0166060 | A1* | 7/2009 | Onozuka | H05K 1/036 174/250 |
| 2010/0303525 | A1 | 12/2010 | Mitsuoka et al. | |
| 2011/0200368 | A1 | 8/2011 | Yamaguchi et al. | |
| 2011/0217093 | A1 | 9/2011 | Tokuda et al. | |
| 2013/0273388 | A1* | 10/2013 | Sun | H05K 1/05 428/621 |

FOREIGN PATENT DOCUMENTS

| | | |
|---|---|---|
| JP | A-2002-333788 | 11/2002 |
| JP | A-2004-61718 | 2/2004 |
| JP | A-2008-224875 | 9/2008 |

(Continued)

*Primary Examiner* — Benjamin Schmitt
(74) *Attorney, Agent, or Firm* — Oliff PLC

(57) ABSTRACT

A fixing device includes a fixing member that fixes a toner image to a recording medium, a pressure member that forms, together with the fixing member, a pressure portion through which the recording medium carrying the toner image yet to be fixed passes, and a heating member including a heating layer that generates heat when energized and an insulating layer that encloses the heating layer so as to electrically insulate the heating layer. The heating member has a curved shape along an inner peripheral surface of the fixing member, in a state in which no external force is applied, and is in contact with the inner peripheral surface of the fixing member.

10 Claims, 9 Drawing Sheets

(56) References Cited

FOREIGN PATENT DOCUMENTS

| | | |
|---|---|---|
| JP | A-2010-217204 | 9/2010 |
| JP | A-2010-231105 | 10/2010 |
| JP | A-2010-276729 | 12/2010 |
| JP | A-2011-164462 | 8/2011 |
| JP | A-2011-180503 | 9/2011 |
| JP | A-2011-221106 | 11/2011 |
| JP | A-2012-113254 | 6/2012 |

* cited by examiner

FIXING DEVICE, HEATING DEVICE, IMAGE FORMING APPARATUS, AND METHOD OF MANUFACTURING HEATING DEVICE

CROSS-REFERENCE TO RELATED APPLICATIONS

This application is based on and claims priority under 35 USC 119 from Japanese Patent Application No. 2013-156670 filed Jul. 29, 2013.

BACKGROUND (i) Technical Field

The present invention relates to a fixing device, a heating device, an image forming apparatus, and a method of manufacturing a heating device.

(ii) Related Art

A fixing device that applies heat to a recording medium having a toner image formed thereon through a fixing member so as to fix the toner image to the recording medium is known as related art.

SUMMARY

According to an aspect of the invention, there is provided a fixing device including a fixing member that fixes a toner image to a recording medium; a pressure member that forms, together with the fixing member, a pressure portion through which the recording medium carrying the toner image yet to be fixed passes; and a heating member including a heating layer that generates heat when energized and an insulating layer that encloses the heating layer so as to electrically insulate the heating layer. The heating member has a curved shape along an inner peripheral surface of the fixing member, in a state in which no external force is applied, and is in contact with the inner peripheral surface of the fixing member.

BRIEF DESCRIPTION OF THE DRAWINGS

An exemplary embodiment of the present invention will be described in detail based on the following figures, wherein.

DETAILED DESCRIPTION

An exemplary embodiment of the present invention will now be described in detail with reference to the accompanying drawings.

Image Forming Apparatus

Figure 1:
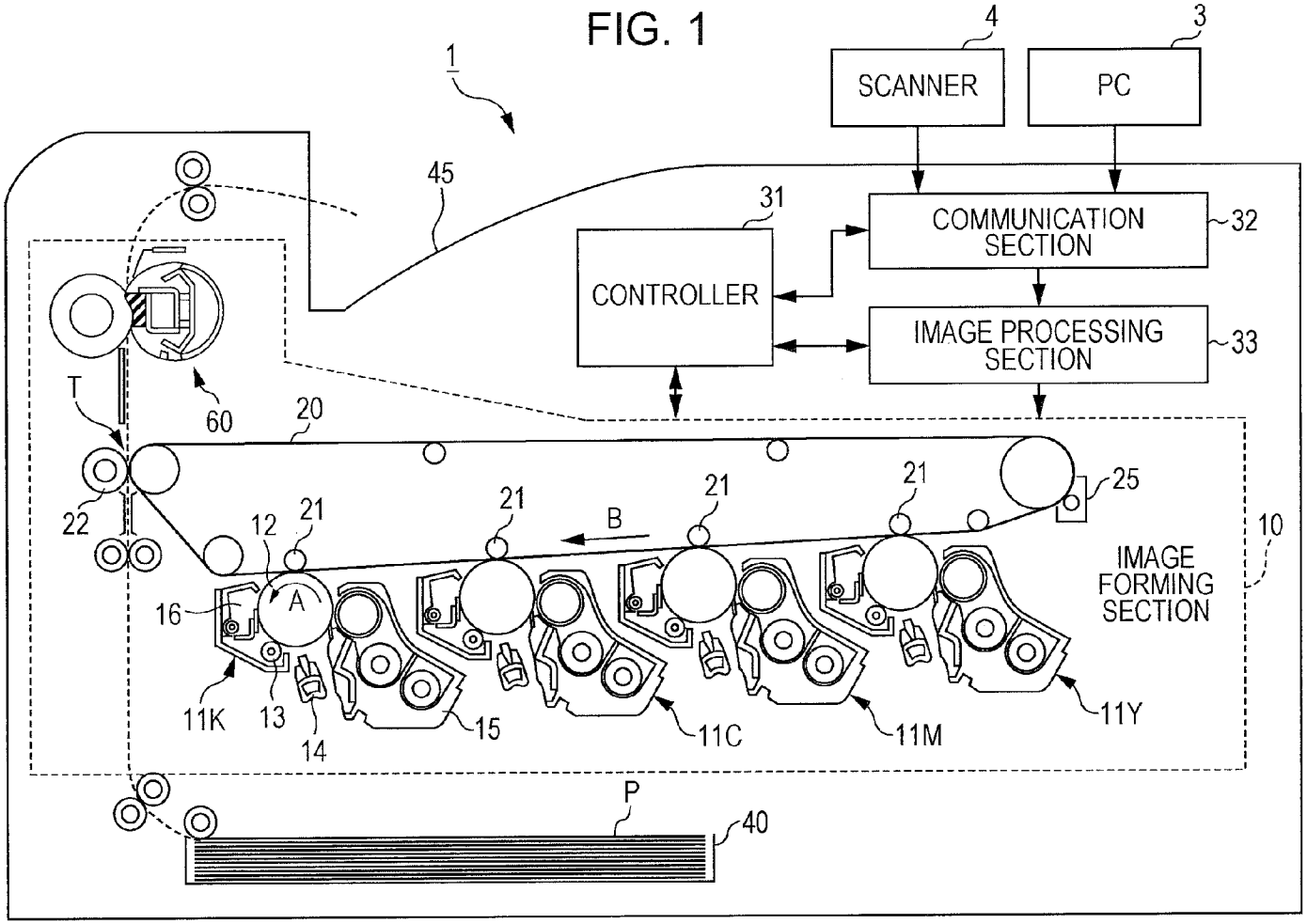
FIG. 1 illustrates an exemplary configuration of an image forming apparatus to which a fixing device is applied according to an exemplary embodiment.

FIG. 1 illustrates an exemplary configuration of an image forming apparatus 1 to which a fixing device is applied according to this exemplary embodiment. The image forming apparatus 1 of FIG. 1 is a so-called tandem color printer, and includes an image forming section 10 that forms an image on the basis of image data and a controller 31 that controls the entire operations of the image forming apparatus 1. The image forming apparatus 1 further includes a communication section 32 that communicates with, for example, a personal computer (PC) 3 or an image reading apparatus (scanner) 4 so as to receive image data, and an image processing section 33 that performs a predetermined image processing operation on the image data received by the communication section 32.

The image forming section 10 includes four image forming units 11Y, 11M, 11C, and 11K (also referred to collectively as "image forming units 11"), as an example of a toner image forming unit, which are disposed in parallel at predetermined intervals. Each image forming unit 11 includes a photoconductor drum 12 on which an electrostatic latent image is formed and that carries a toner image, a charging device 13 that charges the surface of the photoconductor drum 12 with a predetermined potential, a light emitting diode (LED) printhead 14 that performs, on the basis of image data for a corresponding color, exposure on the photoconductor drum 12 charged by the charging device 13, a developing device 15 that develops the electrostatic latent image formed on the photoconductor drum 12, and a drum cleaner 16 that cleans the surface of the photoconductor drum 12 after transfer.

The image forming units 11 have substantially the same configuration, except for the color of toners stored in the developing devices 15, and form toner images of yellow (Y), magenta (M), cyan (C), and black (K), respectively.

The image forming section 10 includes an intermediate transfer belt 20 onto which the toner images of the respective colors formed on the photoconductor drums 12 of the respective image forming units 11 are transferred and superposed, and first transfer rollers 21 by which the toner images of the respective colors formed by the respective image forming units 11 are sequentially transferred (first-transferred) to the intermediate transfer belt 20. The image forming section 10 further includes a second transfer roller 22 by which the toner images of the respective colors having been transferred and superposed on the intermediate transfer belt 20 are transferred all at once (second-transferred) to paper P serving as a recording medium (recording paper), and a fixing unit 60 as an example of a fixing device that fixes the second-transferred toner images of the respective colors to the paper P. Note that, in the image forming apparatus 1 of this exemplary embodiment, the intermediate transfer belt 20, the first transfer rollers 21, and the second transfer roller 22 form a transfer unit.

The image forming apparatus 1 of this exemplary embodiment performs an image forming operation in accordance with the following process under the control of the controller 31. More specifically, image data from the PC 3 or the scanner 4 is received by the communication section 32, and is subjected to a predetermined image processing operation by the image processing section 33 so as to be converted into pieces of image data for the respective colors. The pieces of image data are transmitted to the respective image forming units 11. Then, for example, in the image forming unit 11K that forms a black (K) color toner image, the photoconductor drum 12 rotating in the direction of the arrow A is uniformly charged with the predetermined potential by the charging device 13, and the LED printhead 14 performs scanning exposure on the photoconductor drum 12 on the basis of the K-color image data transmitted from the image processing section 33. Thus, an electrostatic latent image for K color is formed on the photoconductor drum 12. The K-color electrostatic latent image formed on the photoconductor drum 12 is developed by the developing device 15, whereby a K-color toner image is formed on the photoconductor drum 12. Likewise, toner images of yellow (Y), magenta (M), and cyan (C) are formed in the image forming units 11Y, 11M, and 11C, respectively.

The toner images of the respective colors formed on the photoconductor drums 12 of the image forming units 11 are sequentially transferred (first-transferred) to the intermediate transfer belt 20 rotating in the direction of the arrow B by the first transfer rollers 21. Thus, superposed toner images in which toners of the respective colors are superposed are formed. The superposed toner images on the intermediate transfer belt 20 are transported by the rotation of the intermediate transfer belt 20 to an area (second transfer section T) where the second transfer roller 22 is provided. When the superposed toner images reach the second transfer section T, paper P fed from a paper holder 40 is transported to the second transfer section T. Then, the superposed toner images are electrostatically transferred all at once (second-transferred) to the transported paper P by an effect of a transfer electric field produced by the second transfer roller 22 in the second transfer section T.

Subsequently, the paper P having the superposed toner images electrostatically transferred thereto is transported to the fixing unit 60. The superposed toner images on the paper P transported to the fixing unit 60 are heated and pressed by the fixing unit 60 so as to be fixed to the paper P. The paper P having the fixed image formed thereon is transported to a paper stacking part 45 in a paper output section of the image forming apparatus 1.

Meanwhile, toners adhering to the photoconductor drums 12 after the first transfer (first-transfer residual toner) and toners adhering to the intermediate transfer belt 20 after the second transfer (second-transfer residual toner) are removed by the drum cleaners 16 and a belt cleaner 25, respectively.

The image forming apparatus 1 repeats the above image forming operation for the number of pages to be printed.

Configuration of Fixing Unit

Next, the fixing unit 60 of this exemplary embodiment will be described.

Figure 2:
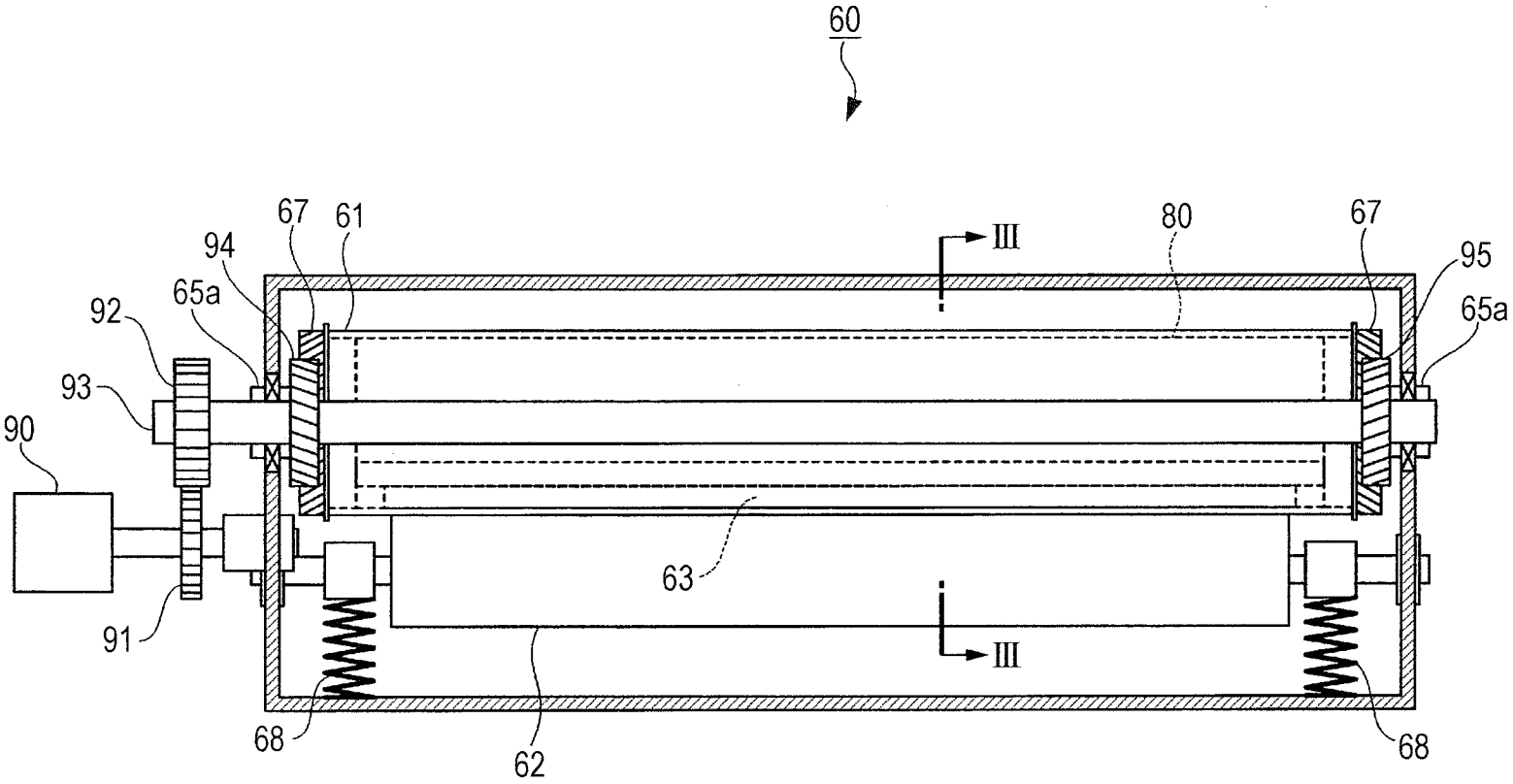
FIG. 2 illustrates the configuration of a fixing unit according to the exemplary embodiment.
Figure 3:
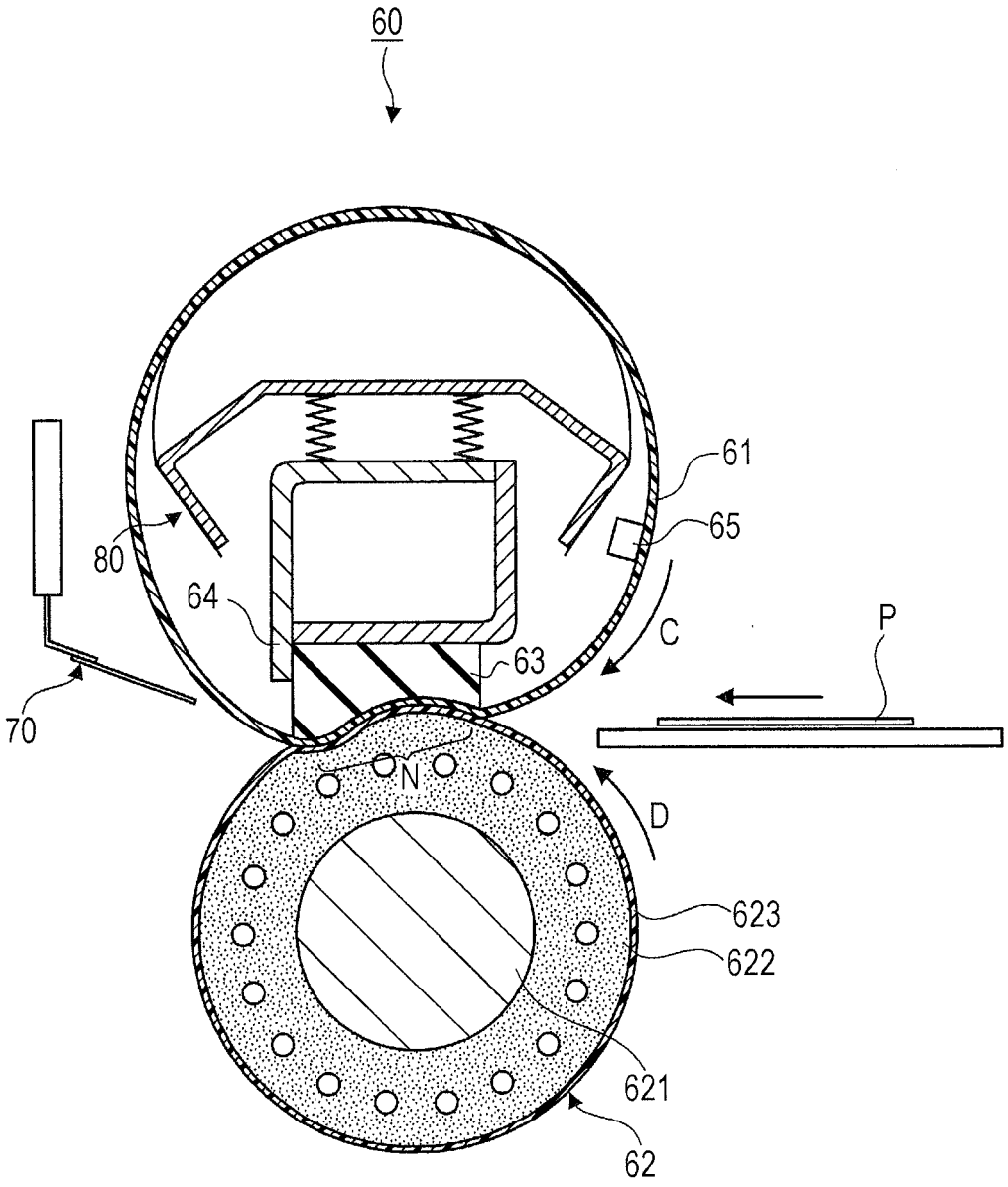
FIG. 3 is a cross-sectional view taken along the line of FIG. 2.

FIGS. 2 and 3 illustrate the configuration of the fixing unit 60 of this exemplary embodiment. More specifically, FIG. 2 is a front view, and FIG. 3 is a cross-sectional view taken along the line of FIG. 2.

Referring first to the cross-sectional view of FIG. 3, the fixing unit 60 includes a heater unit 80 serving as the heat source, a fixing belt 61 as an example of a fixing member that is heated by the heater unit 80 and thus fixes toner images, a pressure roller 62 as an example of a pressure member that is disposed so as to face the fixing belt 61, and a pressing pad 63 that is pressed by the pressure roller 62 with the fixing belt 61 interposed therebetween.

The fixing unit 60 further includes a frame 64 that supports the pressing pad 63 and other elements, a temperature sensor 65 that is in contact with the inner peripheral surface of the fixing belt 61 so as to measure the temperature of the fixing belt 61, and a removal assisting member 70 that assists removal of the paper P from the fixing belt 61.

Fixing Belt

Figure 4:
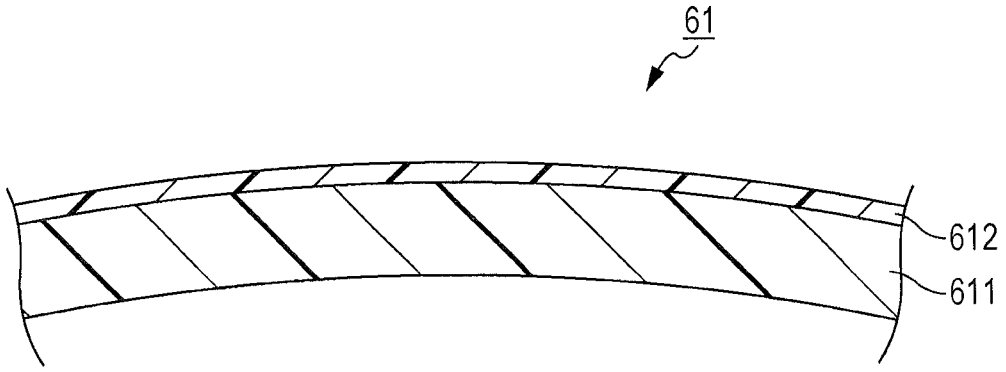
FIG. 4 is a cross-sectional view illustrating layers of a fixing belt.

The fixing belt 61 is an endless belt member that originally has a round cylindrical shape with, for example, a diameter of 30 mm in its original shape (round cylindrical shape) and a width of 300 mm. Referring to FIG. 4 (a cross-sectional view illustrating layers of the fixing belt 61), the fixing belt 61 is a multilayer belt member including a base layer 611 and a release layer 612 disposed over the base layer 611.

The base layer 611 includes a heat-resistant sheet member that provides mechanical strength to the fixing belt 61 as a whole.

The base layer 611 is a polyimide resin sheet having a thickness of 60 μm to 200 μm, for example. In order to achieve more uniform temperature distribution in the fixing belt 61, the polyimide resin sheet may contain a thermally-conductive filler made of aluminum oxide or the like.

The release layer 612 comes into direct contact with unfixed toner images on the paper P, and is therefore made of a material having a high releasability. Examples of such a material include a tetrafluoroethylene-perfluoroalkyl vinyl ether copolymer (PFA), polytetrafluoroethylene (PTFE), a silicone copolymer, and a composite of these materials. If the release layer 612 is too thin, abrasion resistance is insufficient and the service life of the fixing belt 61 is reduced. On the other hand, if the release layer 612 is too thick, the heat capacity of the fixing belt 61 is too large and the warm-up time is increased. Considering the balance between abrasion resistance and heat capacity, the thickness of the release layer 612 may be 1 μm to 50 μm.

In the case of forming a color image in the image forming section 10 (see FIG. 1), an elastic layer made of a heat-resistant elastic material such as silicone rubber may be provided between the base layer 611 and the release layer 612 of the fixing belt 61, for example. The provision of such an elastic layer in the fixing belt 61 makes it possible to improve the capability of fixing a color image compared to the case where this configuration is not employed.

Drive Mechanism of Fixing Belt

Next, the drive mechanism of the fixing belt 61 will be described.

Referring to the front view of FIG. 2, end cap members 67 that rotate the fixing belt 61 in the circumferential direction while maintaining the circular cross-sectional shape of the opposite ends of the fixing belt 61 are fixed to the opposite axial ends of the frame 64 (see FIG. 3). The fixing belt 61 directly receives the rotational driving force at the opposite ends thereof from the end cap members 67, and thus rotates in the direction of the arrow C of FIG. 3 at a processing speed of, for example, 140 mm/s.

As the material of the end cap members 67, so-called engineering plastic having high mechanical strength and heat resistance is used. For example, phenolic resin, polyimide resin, polyamide resin, polyamide-imide resin, PEEK resin, PES resin, PPS resin, LCP resin, or the like are suitable.

As illustrated in FIG. 2, in the fixing unit 60, the rotational driving force of a drive motor 90 is transmitted to a shaft 93 through transmission gears 91 and 92, and then is transmitted from transmission gears 94 and 95 fixed to the shaft 93 to the end cap members 67. Thus, the rotational driving force is transmitted from the end cap members 67 to the fixing belt 61, so that the end cap members 67 and the fixing belt 61 are rotated together.

In this way, since the fixing belt 61 is rotated by the force directly received at the opposite ends of the fixing belt 61, the fixing belt 61 rotates stably.

Pressure Roller

Referring back to FIG. 3, the pressure roller 62 is disposed so as to face the fixing belt 61, and is driven by the fixing belt 61 so as to rotate in the direction of the arrow D of FIG. 3 at a processing speed of, for example, 140 mm/s. The fixing belt 61 is nipped between the pressure roller 62 and the pressing pad 63 such that a nip N is formed. When paper P carrying unfixed toner images passes through the nip N, heat and pressure are applied so as to fix the unfixed toner images to the paper P.

The pressure roller 62 includes a solid aluminum core (column-shaped metal core) 621 with a diameter of, for example, 18 mm, a heat-resistant elastic layer 622 with a thickness of, for example, 5 mm that is disposed over the outer peripheral surface of the core 621 and is made of silicone sponge or the like, and a release layer 623 with a thickness of, for example, 50 μm that is a heat-resistant resin coating formed of carbon-filled PFA or the like or a heat-resistant rubber coating. Pressure springs 68 (see FIG. 2) cause the pressure roller 62 to press the pressing pad 63 with a load of, for example, 25 kgf, with the fixing belt 61 interposed therebetween.

Pressing Pad

The pressing pad 63 is a block member made of a rigid body such as silicone rubber and fluoro rubber, for example, and having a substantially arcuate cross-sectional shape, and is supported by the frame 64 at the inner side of the fixing belt 61. The pressing pad 63 is fixed to extend axially across the area where the pressure roller 62 is in pressure contact with the fixing belt 61. Further, the pressing pad 63 is disposed so as to press the pressure roller 62 with a predetermined load (for example, an average of 10 kgf) with the fixing belt 61 interposed therebetween, across a predetermined width region, whereby the nip N is formed.

Temperature Sensor

The temperature sensor 65 is a thermistor temperature sensor, and includes a temperature detector having a thermistor, which is a material whose resistance value varies with temperature.

Examples of the thermistor used in the temperature detector include various types of thermistors such as a negative temperature coefficient (NTC) thermistor whose resistance decreases as temperature increases, a positive temperature coefficient (PTC) thermistor whose resistance increases as temperature increases, and a critical temperature resistor (CTR) thermistor whose resistance decreases as temperature increases but whose sensitivity increases in a specific temperature range.

Information on the temperature detected by the temperature sensor 65 is transmitted to, for example, the controller 31. The controller 31 controls the heater unit 80 on the basis of the temperature information so as to maintain the temperature of the fixing belt 61 in a predetermined range.

Configuration of Heater Unit

Figure 5A:
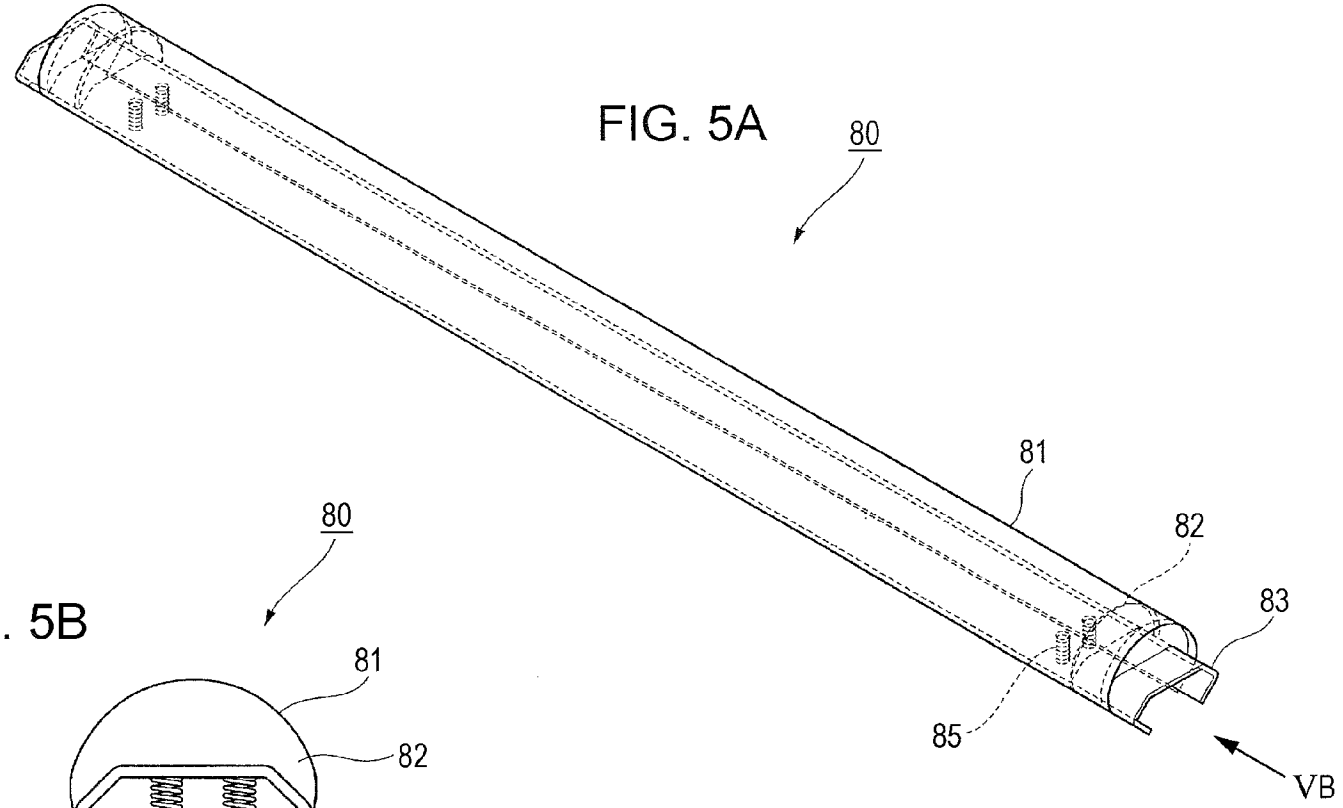
FIGS. 5A and 5B illustrate the configuration of a heater unit according to the exemplary embodiment.
Figure 5B:
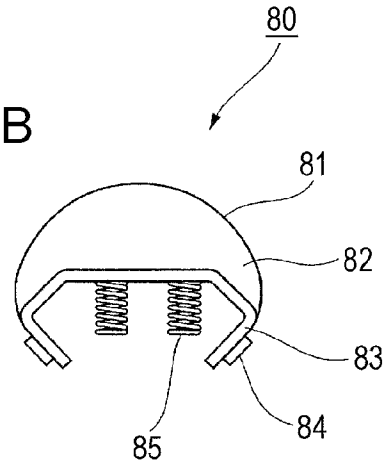

FIGS. 5A and 5B illustrate the configuration of the heater unit 80 according to this exemplary embodiment.

More specifically, FIG. 5A is a perspective view of the heater unit 80, and FIG. 5B illustrates the heater unit 80 as viewed from the direction VB of FIG. 5A.

The illustrated heater unit 80 includes a heater 81 serving as the heat generation source, guides 82 that define the arch shape of the heater 81, an attachment part 83 to which the heater 81 and the guides 82 are attached, bolts 84 that fix the heater 81 to the attachment part 83, and pressing members 85 that press the heater unit 80 against the fixing belt 61.

In this exemplary embodiment, the heater 81 is an example of a heating member that is in contact with the inner peripheral surface of the fixing belt 61 (see FIG. 3) so as to heat the fixing belt 61.

Figure 6A:
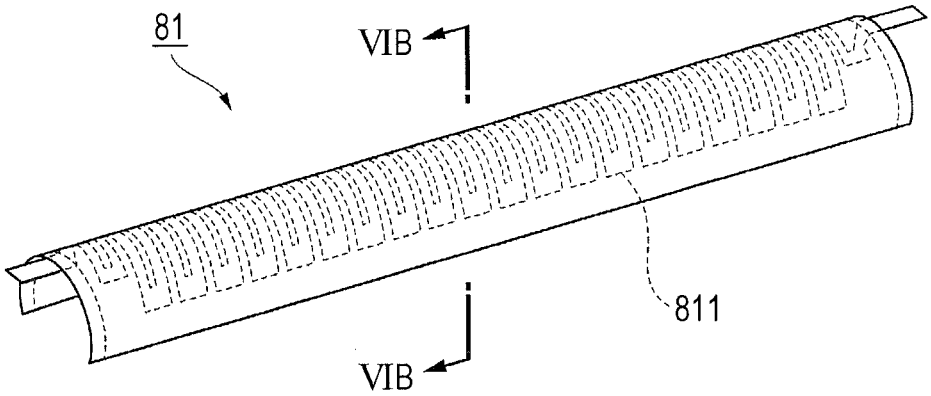
FIGS. 6A and 6B illustrate the configuration of a heater.
Figure 6B:
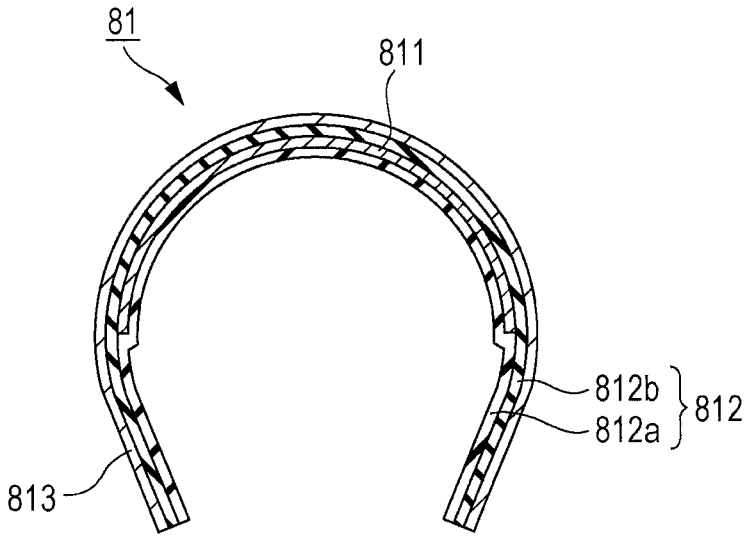

FIGS. 6A and 6B illustrate the configuration of the heater 81. More specifically, FIG. 6A is a perspective view of the heater 81 detached from the guides 82 and the attachment part 83, and FIG. 6B is a cross-sectional view of the heater 81 taken along the line VIB-VIB of FIG. 6A.

Referring to FIGS. 6A and 6B, as will be described below in detail, the heater 81 of this exemplary embodiment maintains an arch shape curved in an arcuate form, even when detached from the guides 82 and the attachment part 83.

As illustrated in FIG. 6B, the heater 81 is configured such that a heating layer 811 is enclosed in an insulating layer 812. Further, the heater 81 includes a thermal diffusion layer 813 at the side in contact with the fixing belt 61.

In this exemplary embodiment, the heating layer 811 is an example of a heating part having a predetermined wiring pattern.

The heating layer 811 is made of an electrically-conductive heating material, and generates heat when energized. In this exemplary embodiment, the heating layer 811 is made of stainless steel having a thickness of 30 μm, for example. Further, the heating layer 811 has a predetermined pattern so as to provide more uniform heating. The heating layer 811 of this exemplary embodiment includes plural basic patterns alternating in the width direction of the heater 81. The plural basic patterns are connected in the longitudinal direction of the heater 81 so as to form a corrugated pattern (see also FIG. 9A, which will be described below).

The insulating layer 812 is a layer that insulates the heating layer 811 and prevents the heating layer 811 from being bent. In this exemplary embodiment, the insulating layer 812 has a two-layer structure including insulating layers 812*a* and 812*b*. The insulating layers 812*a* and 812*b* with the heating layer 811 interposed therebetween are bonded together by thermal compression, so that the heating layer 811 is enclosed in the insulating layer 812. That is, in this case, the insulating layers 812*a* and 812*b* are bonded to form a single layer.

The insulating layers 812*a* and 812*b* need to be made of a material having insulating properties and excellent heat resistance. In this exemplary embodiment, the insulating layer 812*a* is made of thermosetting polyimide having a thickness of 25 μm to 50 μm, for example. The insulating layer 812*b* is made of thermoplastic polyimide having a thickness of 25 μm to 50 μm, for example.

The insulating layer 812 is an example of an adhesive layer that bonds the heating layer 811 and the thermal diffusion layer 813 together.

The thermal diffusion layer 813 diffuses and transfers heat generated by the heating layer 811 to the fixing belt 61. The fixing belt 61 is uniformly heated by the thermal diffusion layer 813, so that variation in the temperature distribution in the fixing belt 61 is reduced. The thermal diffusion layer 813 is an example of a support layer that supports the heating layer 811.

The thermal diffusion layer 813 needs to be made of a material having excellent heat conductivity and excellent heat resistance. In this exemplary embodiment, the thermal diffusion layer 813 is stainless steel having a thickness of 30 μl to 50 μm, for example.

The thermal diffusion layer 813 is bonded to the insulating layer 812*b*. In reality, as will be described below in detail, when the insulating layers 812*a* and 812*b* with the heating layer 811 interposed therebetween are bonded together by thermal compression, the thermal diffusion layer 813 and the insulating layer 812*b* are also bonded together.

Referring back to FIGS. 5A and 5B, when actually used, the heater 81 of this exemplary embodiment is attached to have an arch shape curved in an arcuate form along the inner peripheral surface of the fixing belt 61 so as to be in contact with the inner peripheral surface of the fixing belt 61.

The guides 82 are members disposed one at each longitudinal end of the heater 81 (short side end of the heater 81) and defining the shape of the heater 81 to be an arch shape in contact with the inner peripheral surface of the fixing belt 61.

The guides 82 need to have excellent heat resistance and excellent workability. In this exemplary embodiment, examples of the material of the guides 82 include polyphenylene sulfide (PPS) resin.

The attachment part 83 is disposed in the longitudinal direction of the heater 81. The attachment part 83 is formed by performing a bending process on a stainless steel plate or the like, for example. In this exemplary embodiment, the guides 82 are attached one at each longitudinal end of the attachment part 83. Further, the long side ends of the heater 81 are fixed to the attachment part 83 by the bolts 84 in the longitudinal direction.

Further, in this exemplary embodiment, the heating layer 811 of the heater 81 is not disposed in the areas where the guides 82 and the attachment part 83 are disposed. That is, in the axial direction, the heating layer 811 is disposed in the area between the guides 82 that are disposed at the short side ends of the heater 81. Further, in the rotational direction of the fixing belt 61, the heating layer 811 is provided in the area between the portions where the heater 81 is rigidly fixed at the long side ends thereof to the attachment part 83. Therefore, in the area where the heating layer 811 of the heater 81 is disposed, the heater 81 is not in contact with members other than the fixing belt 61. That is, for example, although the upper surface of the heater 81 in FIGS. 5A and 5B is in contact with the fixing belt 61, the lower surface of the heater 81 in the area where the heating layer 811 is disposed is not in contact with the other members. Thus, a hollow space is formed under the heater 81. Accordingly, it is possible to reduce heat transfer to members other than the fixing belt 61. Further, since the heater 81 has a film shape, it is possible to the heat capacity of the heater 81. This makes it possible to quickly increase the temperature of the fixing belt 61 when the image forming apparatus 1 (see FIG. 1) is turned on and the fixing unit 60 (see FIG. 1) is started. Accordingly, the time (warm-up time) taken to heat the fixing belt 61 to a fixing temperature is reduced.

The pressing members 85 are coil springs, for example. The plural pressing members 85 are disposed in the axial direction of the heater unit 80. In this exemplary embodiment, two pressing members 85 are provided at each axial end of the heater unit 80. That is, a total of four pressing members 85 are provided. An end of each pressing member 85 is fixed to the heater unit 80. The other end is in contact with the frame 64 (see FIG. 3). That is, the pressing members 85 are disposed between the frame 64 and the heater unit 80 so as to press the heater unit 80 against the fixing belt 61 with a pressing force generated by the pressing members 85. This allows the heater 81 of the heater unit 80 to maintain contact with the fixing belt 61.

Configuration of Heater

Next, the heater 81 detached from the guides 82 and the attachment part 83 will be described with reference to FIGS. 6A and 6B. As mentioned above, the heater 81 of this exemplary embodiment maintains the arch shape, even when detached from the guides 82 and the attachment part 83 (see FIGS. 5A and 5B).

More specifically, as illustrated in FIGS. 6A and 6B, the heater 81 is formed such that at least a part thereof where the heating layer 811 is formed is curved along the shape of the inner peripheral surface (see FIG. 3) of the fixing belt 61, even when detached from the guides 82 and the attachment part 83.

In this exemplary embodiment, since the heater 81 has a curved shape when detached from the guides 82 and the attachment part 83, generation of strain and internal stress in the heater 81 is reduced even when the heater 81 is used for heating the fixing belt 61.

Further, in this exemplary embodiment, since generation of strain and so on in the heater 81 is reduced, it is possible to keep the fixing belt 61 in close contact with heater 81.

Figure 7A:
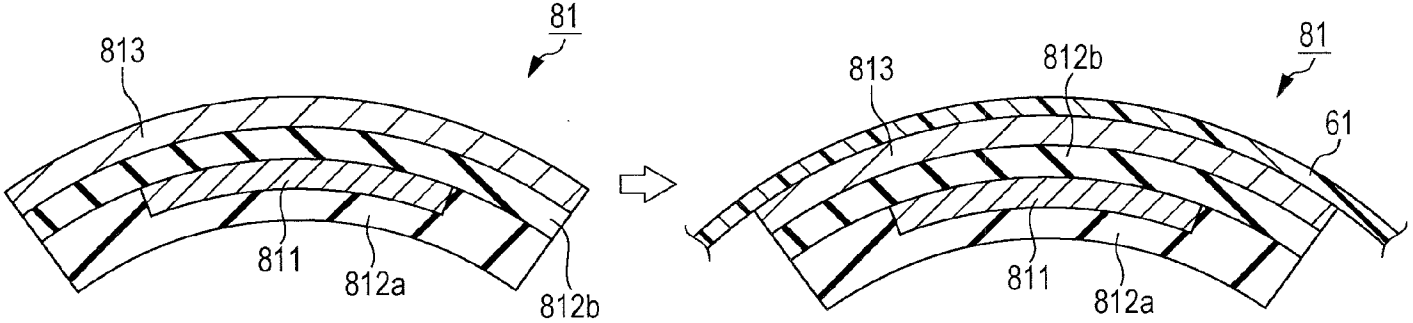
FIGS. 7A and 7B illustrate the differences between the heater of the exemplary embodiment and a related-art heater.
Figure 7B:
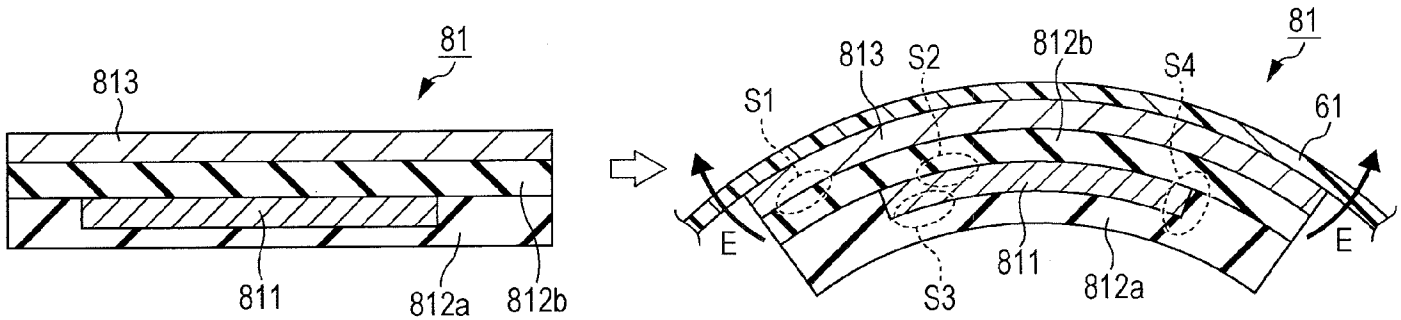
FIG. 7B RELATED ART

FIGS. 7A and 7B illustrate the differences between the heater 81 of this exemplary embodiment and a related-art heater 81. More specifically, FIG. 7A illustrates the heater 81 of this exemplary embodiment, and FIG. 7B illustrates the related-art heater 81. Note that, in FIGS. 7A and 7B, the configuration of the heater 81 is simplified for explanation purposes.

Problems with Related-Art Heater

Referring to FIG. 7B, the related-art heater 81 having no strain or the like in a planar state is curved in accordance with the curvature of the inner peripheral surface of the fixing belt 61, and thus is put into contact with the fixing belt 61 when used.

Usually, the heater 81 is formed by heating a multilayer structure, which includes insulating layers 812*a* and 812*b* with a planar heating layer 811 interposed between and a planar thermal diffusion layer 813 disposed thereon, such that the multilayer structure is bonded by thermal compression.

Accordingly, when the heater 81 is in a planar state illustrated in the left side of FIG. 7B, almost no strain is generated in the interface between the heating layer 811 and the insulating layer 812*a*, the interface between the heating layer 811 and the insulating layer 812*b*, or the interface between the insulating layer 812*b* and the thermal diffusion layer 813. Further, in this example, almost no internal stress is generated in the insulating layer 812 of the heater 81 in the planar state.

In the case where the heater 81 having no strain or the like in the planar state is curved as illustrated in the right side of FIG. 7B, strain and the like are generated in the heater 81.

More specifically, in the case where the heater 81 in the planar state is curved, a force in the tensile direction is exerted on the thermal diffusion layer 813 side defining the outer side of the curve of the heater 81, while a force in the compression direction is exerted on the insulating layer 812*a* side defining the inner peripheral side of the curve of the heater 81. Then, as illustrated in FIG. 7B, strain is generated in an interface S1 between the insulating layer 812*b* and the thermal diffusion layer 813, an interface S2 between the heating layer 811 and the insulating layer 812*b*, and an interface S3 between the heating layer 811 and the insulating layer 812*a*, in accordance with the curvature.

Accordingly, in the heater 81, internal stress for returning from the curved shape to the planar shape is generated in the direction of the arrows E of FIG. 7B.

The heating layer 811 and the thermal diffusion layer 813 are made of stainless steel or the like, for example, while the insulating layer 812 is made of polyimide or the like. That is, the heating layer 811 and the thermal diffusion layer 813 are made of a different material from the insulating layer 812. Therefore, in the heater 81, the heating layer 811 and the thermal diffusion layer 813 have a different rigidity from the insulating layer 812. Further, as mentioned above, the heating layer 811 is not formed across the entire surface of the heater 81 having a rectangular shape, but is formed in some areas of the heater 81 so as to form a predetermined pattern.

Accordingly, in the heater 81, the rigidity varies discontinuously in the areas where the heating layer 811 is present the areas where the heating layer 811 is not present.

Then, in the case where strain or internal stress is generated in the heater 81 when the heater 81 is curved, the heater 81 might be bent at a boundary S4 between an area where the heating layer 811 is present and an area where the heating layer 811 is not present, at which the rigidity is discontinuous, for example.

Thus, when the heater 81 is curved, the curvature of the heater 81 varies in the width direction of the heater 81. This might make it difficult to form the heater 81 to have a continuous arcuate shape along the inner peripheral surface of the fixing belt 61.

Further, in the case where the heater 81 is caused to generate heat in a state in which internal stress is generated in the curved heater 81, stress might be concentrated at the longitudinal center of the heater 81 due to thermal expansion of the heater 81, for example. If stress is concentrate at the longitudinal center of the heater 81, the thermal diffusion layer 813 might be deformed and dented with the stress, for example. Further, if greatly deformed, buckling might occur in the thermal diffusion layer 813.

Further, in the case where the heater 81 is caused to generate heat in a state in which internal stress is generated in the curved heater 81, the heating layer 811 might be deformed due to the difference in the amount of thermal expansion between the heating layer 811 and the insulating layers 812*a* and 812*b*, for example. Further, if the heating layer 811 is greatly deformed, the heating layer 811 might be separated from the insulating layers 812*a* and 812*b*.

Similarly, in the case where the heater 81 is caused to generate heat in a state in which internal stress is generated in the heater 81, the thermal diffusion layer 813 might also be separated from the insulating layer 812*b*.

In particular, in this example, since the heater 81 has a film-shaped configuration with a low heat capacity in order to reduce the warm-up time of the fixing belt 61, the temperature of the heater 81 tends to rise sharply when the fixing belt 61 is heated.

If the temperature of the heater 81 rises in a short time, rapid thermal expansion of the heating layer 811, the insulating layers 812*a* and 812*b*, and the thermal diffusion layer 813 occurs in the heater 81. Thus, deformation and stress concentration due to the thermal expansion of these layers are more likely to occur in the heater 81.

Accordingly, surface irregularities of the heater 81, buckling of the thermal diffusion layer 813, separation of the heating layer 811 and the thermal diffusion layer 813 from the insulating layer 812, and the like as described above are more likely to occur.

Further, if surface irregularities of the heater 81, buckling of the thermal diffusion layer 813, separation of the heating layer 811 and the thermal diffusion layer 813 from the insulating layer 812, or the like as described above occurs, the closeness of contact of the heater 81 with the inner peripheral surface of the fixing belt 61 might be reduced.

Thus, the amount of heat transferred from the heater 81 to the fixing belt 61 is reduced, so that heat tends to be accumulated in the heater 81. As mentioned above, since the heat capacity of the heater 81 is small, the temperature of the heater 81 tends to rise sharply in the case where the amount of heat transfer to the fixing belt 61 is reduced. In this case, ignition or fuming might occur in the heater 81.

Configuration of Heater of Exemplary Embodiment

In this exemplary embodiment, as mentioned above, the heater 81 has a curved shape, even when detached from the guides 82 and the attachment part 83 (see FIGS. 5A and 5B). That is, in the heater 81 of this exemplary embodiment, each of the heating layer 811, the insulating layers 812*a* and 812*b*, and the thermal diffusion layer 813 has a curved shape in a state in which no external force is applied. Thus, in the heater 81 of this exemplary embodiment, the heating layer 811 and the insulating layer 812*a*, the heating layer 811 and the insulating layer 812*b*, and the insulating layer 812*b* and the thermal diffusion layer 813 are respectively in contact with each other at curved surfaces corresponding to the shape of the inner peripheral surface of the fixing belt 61.

Therefore, even when the heater 81 is disposed along the inner peripheral surface of the fixing belt 61 in the actual use conditions, there is little change in the shape of the heater 81 as illustrated in FIG. 7A. Thus, unlike the above-described example of FIG. 7B, in the heater 81 of this exemplary embodiment, almost no internal stress is generated in the direction for returning to the planar shape.

Accordingly, in the heater 81 of this exemplary embodiment, strain is less likely to be generated in the interface between the heating layer 811 and the insulating layer 812*a*, the interface between the heating layer 811 and the insulating layer 812*b*, and the interface between the insulating layer 812*b* and the thermal diffusion layer 813.

With this configuration, in this exemplary embodiment, even when the heater 81 is caused to generate heat for heating the fixing belt 61, it is possible to reduce occurrence of dents and buckling in the thermal diffusion layer 813 of the heater 81. Further, in the heater 81, it is possible to prevent the heating layer 811 and the thermal diffusion layer 813 from being deformed, and thus to prevent the heating layer 811 and the thermal diffusion layer 813 from being separated from the insulating layers 812*a* and 812*b*.

Accordingly, in this exemplary embodiment, it is possible to prevent a reduction in the closeness of contact of the heater 81 with the inner peripheral surface of the fixing belt 61, and thus to prevent a reduction in the amount of heat transfer from the heater 81 to the fixing belt 61. Further, it is possible to prevent an excessive increase in the temperature of the heater 81, and thus to reduce problems such as ignition and fuming in the heater 81.

Further, since it is possible to prevent a reduction in the amount of heat transfer from the heater 81 to the fixing belt 61, it is possible to reduce the warm-up time of the fixing belt 61 compared to the case where the present configuration is not employed.

Method of Manufacturing Heater

Next, a method of manufacturing the heater 81 of this exemplary embodiment will be described.

Figure 8:
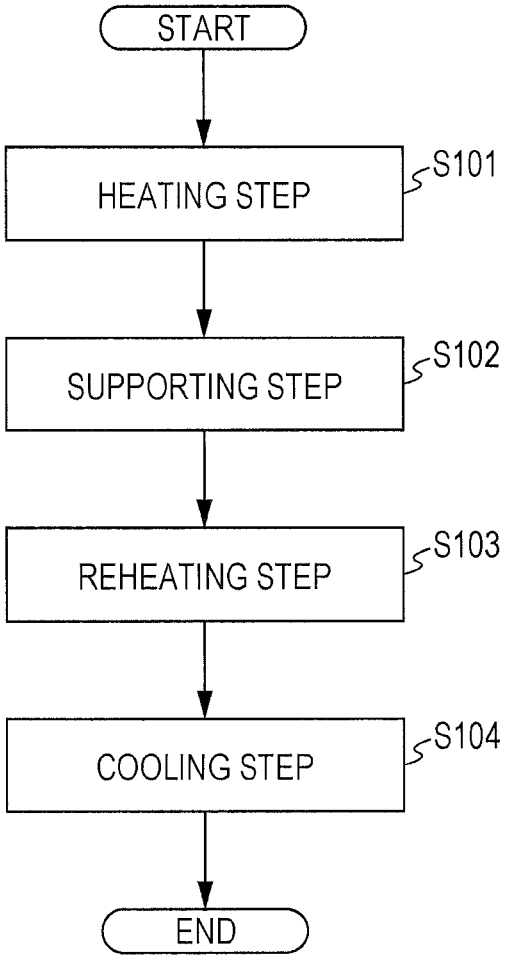
FIG. 8 is a flowchart illustrating a method of manufacturing the heater of the exemplary embodiment.
Figure 9A:
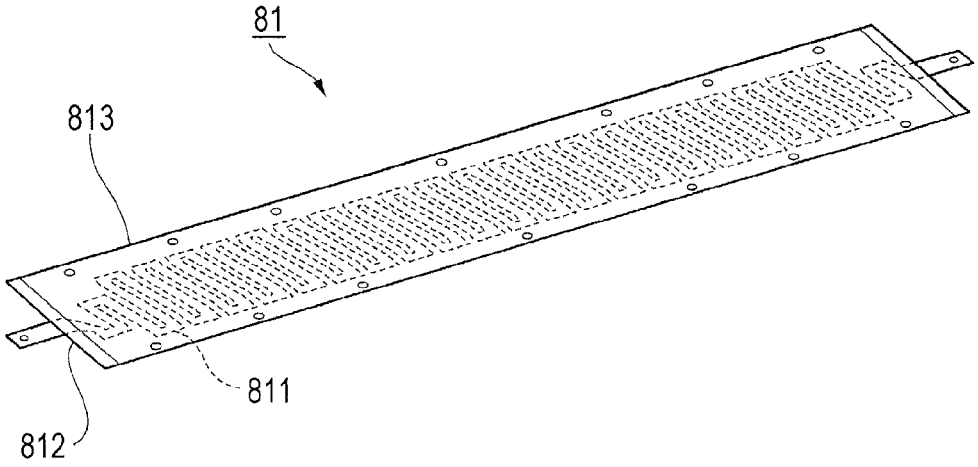
FIGS. 9A and 9B illustrate the method of manufacturing the heater.
Figure 9B:
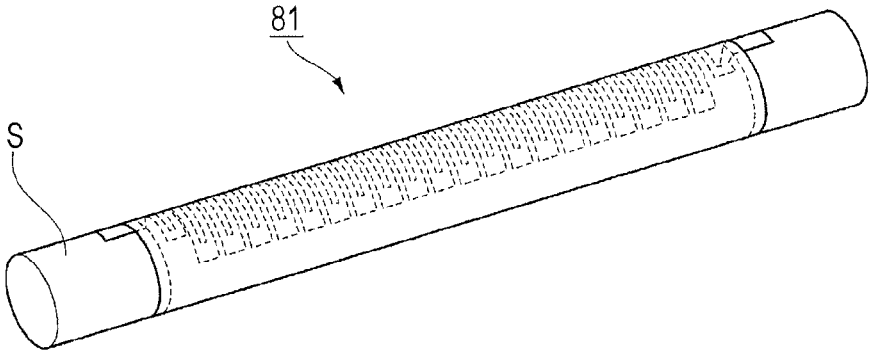

FIG. 8 is a flowchart illustrating the method of manufacturing the heater 81 of this exemplary embodiment. FIGS. 9A and 9B illustrate the method of manufacturing the heater 81.

The heater 81 of this exemplary embodiment is manufactured in the following manner. First, a multiplayer structure including the insulating layers 812*a* and 812*b* with the planar heating layer 811 interposed between and the planar thermal diffusion layer 813 disposed on the insulating layer 812*b* is heated while being pressed (heating step; step S101). Thus, as illustrated in FIG. 9A, the planar heater 81 is obtained.

Note that, in step S101, since the planar heating layer 811 and planar thermal diffusion layer 813 are used, the heater 81 obtained in step S101 has no strain or the like in the planar state.

Then, the planar heater 81 is deformed so as to be curved, and is supported in a curved state (supporting step; step S102). In this case, the heater 81 may be curved to have a shape corresponding to the curvature of the inner peripheral surface of the fixing belt 61 (see FIG. 3).

The heater 81 formed in step S101 has no strain or the like in the planar state. Therefore, when the heater 81 is curved in step S102, strain is generated in the interface between the heating layer 811 and the insulating layer 812*a*, the interface between the heating layer 811 and the insulating layer 812*b*, and the interface between the insulating layer 812*b* and the thermal diffusion layer 813 in the heater 81.

In step S102, the supporting method is not particularly limited as long as the heater 81 is supported in a curved state. In this exemplary embodiment, as illustrated in, for example, FIG. 9B, the heater 81 is deformed by being wound around a cylindrical member S having a predetermined curvature, and is supported while being wound around the cylindrical member S. In this case, in order to prevent the heating layer 811 and the thermal diffusion layer 813 of the heater 81 from being bent, the heater 81 may be supported such that the inner peripheral surface (the insulating layer 812*a*) of the heater 81 is in close contact with the outer peripheral surface of the cylindrical member S.

Subsequently, the heater 81 in the curved state is reheated (reheating step; step S103). The heating temperature in this step is equal to or higher than the glass-transition temperature of the material of the insulating layer 812. In this exemplary embodiment, the insulating layer 812 is made of polyimide having a glass-transition temperature of about 240° C. or higher. Accordingly, the heater 81 is heated to a temperature of 240° C. or higher. For example, the heater 81 is heated to 300° C.

Further, the amount of time to heat the heater 81 is not particularly limited. In this exemplary embodiment, the heater 81 is heated for about 4 hours.

Since the heater 81 is heated to a temperature equal to or higher than the glass-transition temperature of the insulating layer 812 in step S103 in the manner described above, the fluidity of resin or the like (in this example, polyimide) of the insulating layers 812*a* and 812*b* is increased.

Accordingly, the strain that is generated in the interface between the heating layer 811 and the insulating layer 812*a*, the interface between the heating layer 811 and the insulating layer 812*b*, and the interface between the insulating layer 812*b* and the thermal diffusion layer 813 when the heater 81 is curved in step S102 is eliminated.

Then, the heated heater 81 is naturally cooled while maintaining the curved shape (cooling step; step S104). In this exemplary embodiment, the heater 81 is cooled while being wound around the cylindrical member S. In this example, the cooling time is about 2 hours, for example, and the heater 81 is gradually cooled to room temperature.

Thus, the heating layer 811, the insulating layer 812, and the thermal diffusion layer 813 are cured while maintaining the curved shape. In this step, the heating layer 811, the insulating layer 812, and the thermal diffusion layer 813 are cured, with the strain in the interface between the heating layer 811 and the insulating layer 812*a*, the interface between the heating layer 811 and the insulating layer 812*b*, and the interface between the insulating layer 812*b* and the thermal diffusion layer 813 eliminated.

With the above steps, the heater 81 of FIG. 6A is obtained. More specifically, the heater 81 having a curved shape in a state in which no external shape is applied, and having almost no strain in the interface between the heating layer 811 and the insulating layer 812*a*, the interface between the heating layer 811 and the insulating layer 812*b*, or the interface between the insulating layer 812*b* and the thermal diffusion layer 813 is obtained.

Then, as illustrated in FIGS. 5A and 5B, the heater 81 obtained with the steps described above is supported at the opposite longitudinal ends thereof by the guides 82 and is attached to the attachment part 83 so as to be used for heating the fixing belt 61.

As described above, the heater 81 of this exemplary embodiment has a curved shape in a state in which no external force is applied. With this configuration, in the heater 81 of this exemplary embodiment, almost no strain is generated in the interface between the heating layer 811 and the insulating layer 812*a*, the interface between the heating layer 811 and the insulating layer 812*b*, or the interface between the insulating layer 812*b* and the thermal diffusion layer 813.

Since this heater 81 is used for heating the fixing belt 61 and the like, it is possible to reduce occurrence of surface irregularities of the heater 81, buckling of the thermal diffusion layer 813, separation of the heating layer 811 and the thermal diffusion layer 813 from the insulating layer 812, and the like. Accordingly, it is possible to prevent a reduction in the closeness of contact of the heater 81 with the fixing belt 61 and the like.

Further, this allows the heater 81 to heat the fixing belt 61 in a short time. Thus, it is possible to reduce the warm-up time of the fixing unit 60, compared to the case where the present configuration is not employed.

In this exemplary embodiment, the heater 81 has a shape corresponding to the inner peripheral surface of the fixing belt 61 even when detached from the guides 82 and the attachment part 83. However, the heater 81 does not need to have the same curvature as the inner peripheral surface of the fixing belt 61. That is, as long as the heater 81 in a state in which no external force is applied has a curved shape such that the thermal diffusion layer 813 is located at the outer peripheral side, the curvature of the heater 81 may be different from the curvature of, for example, the inner peripheral surface of the fixing belt 61.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing member that fixes a toner image to a recording medium;

a pressure member that forms, together with the fixing member, a pressure portion through which the recording medium carrying the toner image yet to be fixed passes; and a heating member comprising:

a heating layer that generates heat when energized, and an insulating layer that encloses the heating layer so as to electrically insulate the heating layer;

guides disposed at each longitudinal end of the heating member and along an inner peripheral surface of the heating member, wherein the guides are curved so as to define the shape of the heating member and the heating member is disposed in between the guides, wherein the heating member has a curved shape along an inner peripheral surface of the fixing member, in a state in which no external force is applied, and is in contact with the inner peripheral surface of the fixing member, and wherein the heating member has a curved shape when attached and detached from the guides.

2. The fixing device according to claim 1, wherein an interface between the heating layer and the insulating layer of the heating member is a curved surface corresponding to the inner peripheral surface of the fixing member, in a state in which no external force is applied.

3. The fixing device according to claim 1, wherein the heating member further includes a thermal diffusion layer that is bonded to the heating layer by the insulating layer and that diffuses and transfers heat from the heating layer to the fixing member; and wherein an interface between the thermal diffusion layer and the insulating layer is a curved surface corresponding to the inner peripheral surface of the fixing member, in a state in which no external force is applied.

4. The fixing device according to claim 1, wherein the heating member further comprises a thermal diffusion layer that makes direct contact with the fixing member, makes direct contact with the insulating layer, and is separated from the heating layer by the insulating layer.

5. A heating device comprising:

a heating layer that generates heat, when energized, so as to heat a fixing member, the fixing member fixing a toner image to a recording medium, the heating layer being disposed in a heating member, and an insulating layer that encloses the heating layer so as to electrically insulate the heating layer;

wherein guides are disposed at each longitudinal end of the heating device and along an inner peripheral surface of the heating member so that the heating member is disposed in between the guides, the guides being curved so as to define the shape of the heating member, Wherein the heating device has a curved shape when attached and detached from the guides, and wherein the insulating layer has a curved shape corresponding to an inner peripheral surface of the fixing member, in a state in which no external force is applied.

6. The heating device according to claim 5, wherein an interface between the heating layer and the insulating layer is a curved surface corresponding to the inner peripheral surface of the fixing member, in a state in which no external force is applied.

7. The heating device according to claim 6, further comprising:

a thermal diffusion layer that is bonded to the heating layer by the insulating layer and that diffuses and transfers heat from the heating layer to the fixing member;

wherein an interface between the thermal diffusion layer and the insulating layer is a curved surface corresponding to the inner peripheral surface of the fixing member, in a state in which no external force is applied.

8. The heating device according to claim 5, further comprising a thermal diffusion layer that makes direct contact with the fixing member, makes direct contact with the insulating layer, and is separated from the heating layer by the insulating layer.

9. An image forming apparatus comprising:

a toner image forming unit that forms a toner image;

a transfer unit that transfers the toner image to a recording medium;

a fixing member that fixes the toner image to the recording medium;

a pressure member that forms, together with the fixing member, a pressure portion through which the recording medium carrying the toner image yet to be fixed passes; and a heating member comprising:

a heating layer that generates heat when energized, and an insulating layer that encloses the heating layer so as to electrically insulate the heating layer;

guides disposed at each longitudinal end of the heating member and along an inner peripheral surface of the heating member, wherein the guides are curved so as to define the shape of the heating member and the heating member is disposed in between the guides, wherein the heating member has a curved shape along an inner peripheral surface of the fixing member, in a state in which no external force is applied, and is in contact with the inner peripheral surface of the fixing member, and wherein the heating member has a curved shape when attached and detached from the guides.

10. The image forming apparatus according to claim 9, wherein the heating member further comprises a thermal diffusion layer that makes direct contact with the fixing member, makes direct contact with the insulating layer, and is separated from the heating layer by the insulating layer.

* * * * *